US007278489B2

(12) United States Patent
Matic

(10) Patent No.: US 7,278,489 B2
(45) Date of Patent: Oct. 9, 2007

(54) GAS TURBINE FOR OIL LIFTING

(76) Inventor: Juraj Matic, Malo Trojstvo 12, 43226 Veliko Trojstvo (HR)

( * ) Notice: Subject to any disclaimer, the term of this patent is extended or adjusted under 35 U.S.C. 154(b) by 741 days.

(21) Appl. No.: 10/821,324

(22) Filed: Apr. 9, 2004

(65) Prior Publication Data

US 2005/0135944 A1 Jun. 23, 2005

(30) Foreign Application Priority Data

Oct. 12, 2001 (HR) ..... P 20010739 A
Oct. 11, 2002 (WO) ..... PCT/HR02/00047

(51) Int. Cl.
*E21B 43/16* (2006.01)

(52) U.S. Cl. ..... 166/372; 166/242.3; 417/111; 417/405; 137/155

(58) Field of Classification Search ..... 166/372, 166/242.2, 242.3, 106; 417/405, 111, 115; 137/109, 115.01, 155
See application file for complete search history.

(56) References Cited

U.S. PATENT DOCUMENTS 3,171,630 A 3/1965 Harney et al.
3,299,823 A * 1/1967 Marshall ..... 166/62
4,003,678 A 1/1977 David
4,292,011 A 9/1981 Erickson
4,614,232 A 9/1986 Jurgens et al.

FOREIGN PATENT DOCUMENTS

GB 2372271 8/2002

* cited by examiner

*Primary Examiner*—David Bagnell
*Assistant Examiner*—Daniel P Stephenson
(74) *Attorney, Agent, or Firm*—Graham & Dunn PC; Kathleen T. Petrich

(57) ABSTRACT

Gas turbine driven oil lifting device for increasing the quantity of oil obtained over a specified time (e.g. barrels per day) and the percentage of total amount obtained from oil-bearing geological deposits. The device is installed in a technical column (1) and consists of sections (12) and (18), separated by a bypass packer (11), on which a gas turbine (9) is fixed by a coupling (14) and a tubing (17) with a plurality of valves (four preferred: (3), (4), (6), and (8)) that are fixed to the gas turbine (9) by a coupling (15). Above the gas turbine (9) is a check valve (16) that is installed within the tubing (17). Parallel with the tubing (17) is a supply tube (2) of the gas turbine that is fixed by at least one coupling. The bottom end of the supply tube (2) is connected to an opening (20) at an upper head (34) of the gas turbine (9) by a flexible hose (7). The device may operate continually and periodically. The device may be applied for recovery of liquids from all liquid-bearing geological deposits having insufficient pressure for natural flow.

12 Claims, 3 Drawing Sheets

GAS TURBINE FOR OIL LIFTING

RELATED APPLICATIONS

This application claims priority to PCT International Application Serial No. PCT/HR02/00047, filed Oct. 11, 2002, and entitled "Gas Turbine For Oil Lifting," which claims priority to Croatian application P20010739A, filed Oct. 12, 2001.

TECHNICAL FIELD

The invention relates to the field of oil production, and in particular to the recovery of oil from deep wells.

BACKGROUND OF THE INVENTION

Processes for increasing production in "the unit of time" (that is at a particular given time or over a specified time, e.g. barrels per day) and percentage of oil quantity obtained from oil-bearing deposits, used so far, may be divided into chemical, biological and mechanical processes. Chemical processes include the injection of various chemical agents in oil-bearing deposits and to decrease oil viscosity and facilitate it to flow into a bore hole or bore holes. Biological processes include the injection of microorganisms in oil-bearing deposits, where the replication and metabolism products thereof increase the oil deposit pressure and decrease the viscosity of oil. Mechanical processes include processes for the enlargement of the drainage zone, and for increasing the oil deposit pressure and devices for pumping the oil from bore holes. Processes for the enlargement of the drainage zone include hydraulic fracturing processes and making of horizontal bores. Processes for increasing deposit pressure are gas drive and water drive recovery. Devices used for recovery of oil from bore holes having pressure insufficient for natural flow are: bore hole pumps, bore hole centrifugal pumps, screw suction pumps, diaphragm suction pumps, and gas-driven lifting devices. Such gas-driven lifting devices may be of a permanent type, a periodical type, a type of piston lift, and a chamber lift and device for recovery of oil fluid from deep wells, such as disclosed in Croatian patent HR P920143.

A disadvantage of the fore-mentioned solutions, which include a device for recovery of oil fluid from deep wells, is that any of those solutions, used individually, does not increase production dynamics or percentage of oil quantity obtained from the oil-bearing deposits or maintain control over the production process. Additional disadvantages from the known device for recovery of oil fluid from deep wells are that installation is complex and the operation is continuous. Moreover, the quantity of oil obtained over a specified time is comparatively small and restricted by dynamic pressure, which is generated by such an operating regime without damaging the oil bearing deposit.

The aim of the solution according to this application is to construct such a device that will increase production over a specified time and increase the percentage of oil quantity obtained from the oil-bearing deposit, all while using very little energy and maintaining control over production.

SUMMARY OF THE INVENTION

The present invention relates to a gas turbine driven oil lifting device for obtaining oil from deep wells. The structural design of the gas turbine driven oil lifting device provides for the division of a production column-casing (or technical column) that has two parts or sections separated by a bypass packer. A gas turbine is fixed above the bypass packer. A tubing is fixed above the gas turbine. Above the turbine, a check valve is set within the tubing. Fixedly part of the tubing, but above the turbine and the check valve, is a plurality of spaced-apart valves for lifting the oil fluid. Each valve has various opening pressures in which each valve is installed on the tubing. The valve positioned closest to the gas turbine would have the lowest opening pressure. Each subsequent spaced-apart valve would have a slightly higher opening pressure. In the area (generally ring-shaped) between the tubing and the casing is a turbine supply tube, which is fixed to the tubing by at least one collar. The bottom end of the turbine supply tube is fixed to a rotor inlet of the gas turbine by a flexible hose.

Structural connection of elements, carried out in the afore-mentioned manner, allows gas to be driven by means of a compressor through the turbine supply tube to the gas turbine (via the inlet), thereby, starting to revolve the gas turbine. The gas is driven out from the gas turbine through a check valve entering a ring area defined as the area between the tubing and the casing. Turbine blades allow rotation of a rotor that contains a rotary pump. Rotation of a rotary pump, which is immersed in oil, drives oil upwards into the tubing.

Introduction of gas in the ring area causes a pressure increase in it and opens the bottom-most valve (closest to the check valve and gas turbine). The opening pressure of that bottom-most valve determines the difference between the turbine inlet and outlet pressures. Gas enters through it into the tubing, mixes with oil, and therewith facilitates the oil to be lifted.

These and other features and benefits will be discussed in further detail in the various figures of the attached drawings, the Brief Description of the Drawings, and the Best Mode for Carrying Out the Invention.

BRIEF DESCRIPTION OF THE DRAWINGS

Like reference numerals are used to designate like parts throughout the several views of the drawings, wherein.

BEST MODE FOR CARRYING OUT THE INVENTION

Figure 1:
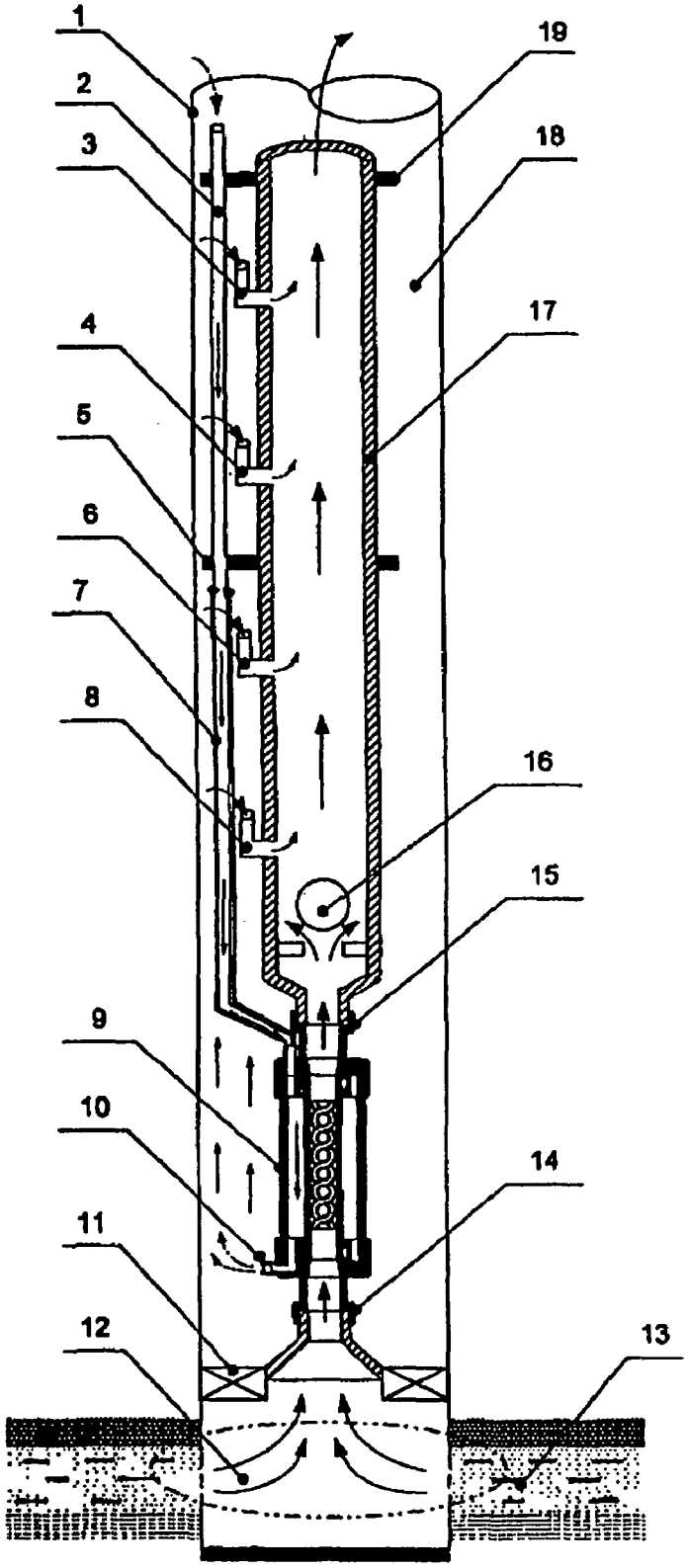
FIG. 1 is a section view of the gas turbine driven lifting device according to the invention.
Figure 2:
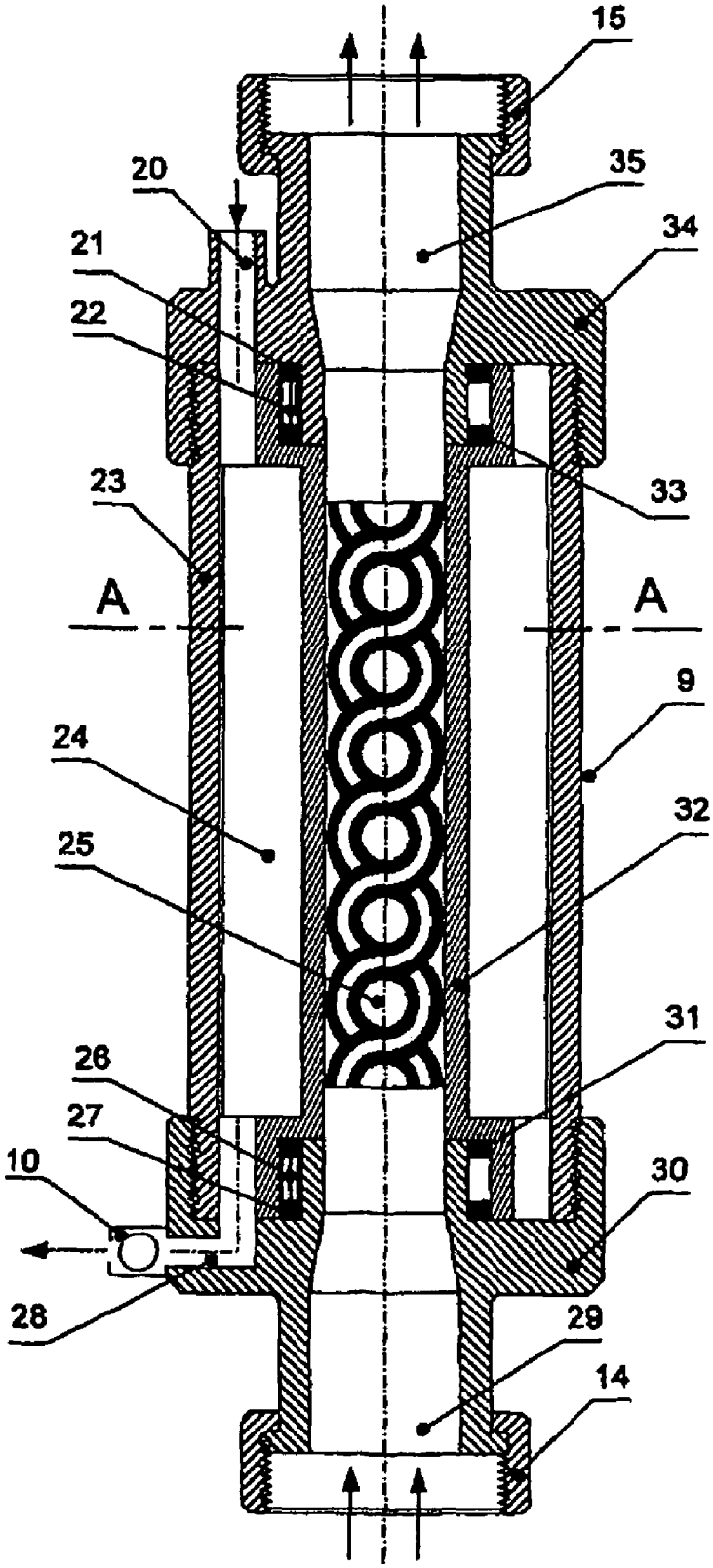
FIG. 2 is an enlarged section view of the gas turbine of FIG. 1.
Figure 3:
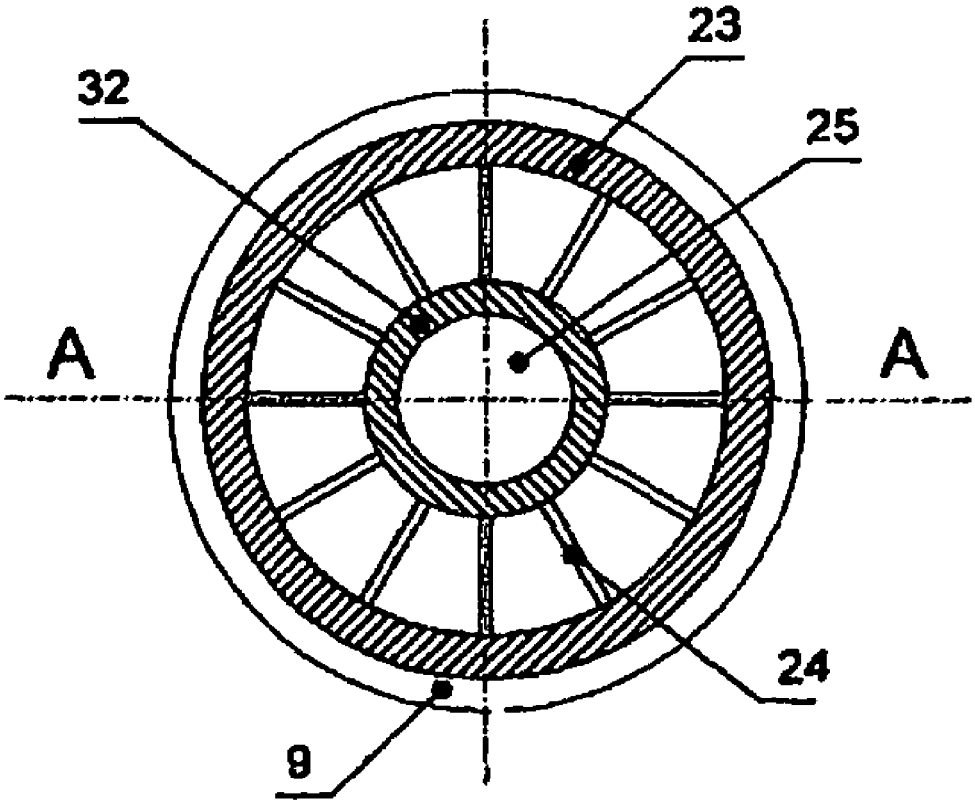
FIG. 3 is a cross section of FIG. 2, taken substantially across lines A-A.

Referring to FIGS. 1-3, the gas turbine driven lifting device of the present invention consists of a production column-casing (or technical column) (1), which is divided into two sections (12) and (18) by a bypass packer (11). In section (18), a gas turbine (9) is fixed to the bypass packer (11) by a coupling (14). Within the casing (1) is a tubing (17) that is fixed to a gas turbine (9) by another coupling (15). A check valve (16) is set within the tubing (17) above the gas turbine (9). Positioned above the check valve (16) and the gas turbine (9), are a plurality of spaced-apart spindle valves, all fixed to the tubing (17) and set one above the other, four of which is the preferred number: (3), (4), (6) and (8), as illustrated in FIG. 1. Parallel with tubing (17) is a turbine supply tube (2), which is fixed to tubing (17) by at least one stabilizing collar (two are shown at (5) and (19)).

The turbine supply tube (2) is fixed to the gas turbine by a flexible hose (7). Gas turbine (9) consists of a rotor (32), which has blades (24) rotatably mounted to a rotary pump (25) positioned interior of the rotor (32). Rotor (32) of gas turbine (9) is set within a cylinder casing (23) having a bottom head (30) and an upper head (34). On the upper head (34) are openings (20) and (35). Opening (20) is a turbine inlet, and opening (35) is a turbine outlet that is screwed into a coupling (15). On the bottom head (30) are openings (28) and (29). Opening (28) is an outlet in which a second check valve (10) is fixed. Opening (29) is a gas turbine inlet screwed into a coupling (14). The rotor (32) is rotationally embedded in the upper head (34) within a bearing (22) and sealed via shaft seals (33). Similarly, the rotor (32) is rotationally embedded into the bottom head (30) within a bottom bearing (26) and sealed via shaft seals (27). In casing (1), the gas turbine (9) is fixed to the bypass packer (11) by coupling (14), and to tubing (17) by coupling (15).

The device operates as follows: gas under pressure is driven from the compressor though a supply tube of the turbine (2), which is connected by a flexible pipe (7) to the opening (20) of the upper head (34), then enters the cylinder (23) of the gas turbine (9), and activates the blades (24) that rotate the rotor (32). Rotary pump (25), which is immersed in oil, rotates together with the rotor (32). By its rotation, rotary pump (25) drives oil from the bottom part of casing (1) into tubing (17). Gas leaves the cylinder (23) through an opening (28) in the lower head (30), and enters the ring area (18) within casing (1). The ring area is preferably hermetically closed on its upper and lower sides. An increase of gas pressure in the ring area (18) opens valves (3), (4), (6), (8). The uppermost valve (illustrated as valve (8) also serves as a regulator of difference between the turbine pressure and flow through the turbine. It is adjusted to the lowest opening pressure. Possible further increase of pressure in the ring area (18) opens in turn: valves (6), then (4), and last, valve (3).

The valves preferably open and close automatically depending on opening pressures, to which they are adjusted. Opening of the valves in this manner (and as described in the paragraph above) allows gas to enter from the ring area (18) into the tubing (17) and thereby lift oil while decreasing the pressure of the oil affecting the gas turbine (9) and the rotary pump (25). Gas turbine (9) starts to rotate faster and lifts larger quantities of oil. When the supply of gas through the turbine supply tube (2) stops, the turbine (9) momentarily stops to operate.

Check valve (16), which has been open during the turbine operation, closes owing to pressure of hydrostatic column in the tubing (17). This action hermetically separates the area of low pressure in section (12), created by turbine operation (9), from the upper part of the tubing (17). Owing to pressure differential, oil flows from the distant parts of the oil deposit(s) to the area of lower pressure (12) created by turbine operation. After a certain time, owing to inflow of oil to the area of lower pressure (12), the pressure in area (12) increases. If the pressure in area (12) exceeds the pressure of hydrostatic column in the tubing (17), the check valve (16) opens and allows free flow of oil through the turbine (9). With new introduction of gas in the turbine (9), the turbine (9) starts to operate and the cycle repeats.

Check valve (10) at the turbine outlet (28) prevents fluid from entering the turbine during the well completion process.

In industrial applications of the invention, the invention is intended to increase the recovery of liquids from liquid-bearing geological deposits, such as recovery of oil or water from deep wells. This is particularly the case where partial depletion of deposits is present and where, owing to the deposit low pressure, natural flow is missing. The intention is to increase the quantity of oil obtained from the deposit in a specified time and to increase the percentage of total quantity of liquid obtained from the deposit, all while using the least energy possible.

The application of the technical solution according to this invention includes usual procedures, equipment, and material, provided that the staff is additionally trained for controlling and handling of the equipment.

Safety working measures are of standard type, and are not environmentally dangerous.

This solution provides for periodical turbine operation on high velocity rotation resulting in a large quantity of liquid recovered in a short period of time and creation of low pressure in bore hole areas, extending to oil bearing deposits.

The illustrated embodiments are only examples of the present invention and, therefore, are non-limitive. It is to be understood that many changes in the particular structure, materials, and features of the invention may be made without departing from the spirit and scope of the invention. Therefore, it is the Applicant's intention that its patent rights not be limited by the particular embodiments illustrated and described herein, but rather by the following claims interpreted according to accepted doctrines of claim interpretation, including the Doctrine of Equivalents and Reversal of Parts.

The invention claimed is:

1. A gas turbine driven oil lifting device for increasing production of oil over a specified time period comprising:

a production column-casing consisting of a tubing connected to a gas turbine having two opposing ends defined by upper and lower portions, all positioned within the casing;

the gas turbine has a turbine inlet and a turbine outlet positioned near its upper end and said gas turbine also has a turbine inlet and a turbine outlet near its lower end, all positioned within said casing; within said upper end outlet and lower end inlet is a rotor assembly for rotation of a fluid in a directionally-oriented flow;

the casing is separated into two parts by a bypass packer, which is coupled to an end of the gas turbine, so as to position the entire gas turbine and tubing within the part above the bypass packer; within said tubing and positioned above said gas turbine is a check valve;

fixed to said tubing is a plurality of spaced-apart spindle valves all positioned on the tubing and positioned above the check valve, with a bottom-most spindle valve having the lowest opening pressure and positioned nearest the check valve, and an upper-most spindle valve having the greatest opening pressure; and a supply tube to the gas turbine is fixedly-positioned along the tubing connected to the gas turbine near the upper end gas turbine inlet with a second check valve installed at the gas turbine outlet near the lower end.

2. The gas turbine driven oil lifting device according to claim 1 wherein there are four spindle valves spaced apart and positioned on the tubing and each valve has a stepped increased opening pressure beginning from the bottom-most valve closest to the gas turbine to the upper-most valve farthest away from the gas turbine.

3. The gas turbine driven oil lifting device according to claim 1 wherein the supply tube is fixed along the tubing by a pair of stabilizing collars.

4. The gas turbine driven oil lifting device according to claim 1 wherein the bypass packer and the first check valve hermetically separate the two parts of the casing.

5. The gas turbine driven oil lifting device according to claim 3 wherein the supply tube ends at a flexible tube, which is connected with the gas turbine at an inlet near the upper end of the turbine.

6. The gas turbine driven oil lifting device according to claim 1 wherein the second check valve is installed at the turbine outlet, preventing the entry of fluid in the turbine during the well completion process.

7. The gas turbine driven oil lifting device according to claim 1 wherein the first check valve prevents return of oil through the turbine to the lower part of the casing below the bypass packer.

8. A process of adjusting a gas turbine driven oil lifting device, where said device consists of a production column-casing consisting of a tubing connected to a gas turbine having two opposing ends defined by upper and lower portions, all positioned within the casing, with the gas turbine having a turbine inlet and a turbine outlet positioned near its upper end and said gas turbine also having a turbine inlet and a turbine outlet near its lower end, and within said upper end outlet and lower end inlet is a rotor assembly for rotation of a fluid in a directionally-oriented flow, all positioned within said casing, with the casing separated into two parts by a bypass packer, and with a plurality of spaced-apart spindle valves all fixed to and positioned along the tubing and above the check valve, with a bottom-most spindle valve positioned nearest the check valve and an upper-most spindle valve having the greatest opening pressure; and with a supply tube to the gas turbine that is fixedly-positioned along the tubing connected to the gas turbine near the upper end gas turbine inlet with a second check valve installed at the gas turbine outlet near the lower end; said process comprising:

adjusting the opening pressure of the bottom-most valve, which has the lowest opening pressure; and adjusting the opening pressure of the next bottom-most valve, which has a slightly higher opening pressure.

9. The process according to claim 8 wherein there are four spindle valves spaced apart and positioned on the tubing and having stepped increasing opening pressure from the bottom-most valve closest to the gas turbine to the uppermost valve farthest away from the gas turbine; where the process further comprises:

adjusting the bottom-most spindle valve;

adjusting the next bottom-most spindle valve;

adjusting the third bottom-most spindle valve; and adjusting the upper-most spindle valve.

10. The process according to claim 8 further comprising adjusting of opening pressure of the bottom-most spindle valve, next to the turbine, under constant pressure of gas from the surface, and adjusting the difference between the turbine inlet and outlet pressures, and adjustment of flow through bottom-most valve and adjusting the flow of gas through the turbine over a specified period of time.

11. A method of use of a gas turbine driven oil lifting device consisting of a production column-casing consisting of a tubing connected to a gas turbine having two opposing ends defined by upper and lower portions all positioned within the casing, with the gas turbine having a turbine inlet and a turbine outlet positioned near its upper end, and said gas turbine also having a turbine inlet and a turbine outlet near its lower end, and within said upper end outlet and lower end inlet is a rotor assembly for rotation of a fluid in a directionally-oriented flow, all positioned within said casing, with the casing separated into two parts by a bypass packer, and with a plurality of spaced-apart spindle valves all fixed to and positioned along the tubing and above the check valve, with a bottom-most spindle valve positioned nearest the check valve and an upper-most spindle valve having the greatest opening pressure, and with a supply tube to the gas turbine that is fixedly-positioned along the tubing connected to the gas turbine near the upper end gas turbine inlet with a second check valve installed at the gas turbine outlet near the lower end;

said method comprising the utilization of the device for lifting oil by allowing operation of the turbine at a high velocity of rotation of a plurality of blades of the rotor assembly resulting in a large amount of oil lifted in a short period of time and generation of a negative pressure area in the part of the casing below the bypass packer after the termination of the turbine operation and closing of the second check valve.

12. A method of use of a gas turbine driven oil lifting device consisting of a production column-casing consisting of a tubing connected to a gas turbine having two opposing ends defined by upper and lower portions all positioned within the casing, with the gas turbine having a turbine inlet and a turbine outlet positioned near its upper end and said gas turbine also having a turbine inlet and a turbine outlet near its lower end, and within said upper end outlet and lower end inlet is a rotor assembly for rotation of a fluid in a directionally-oriented flow, all positioned within said casing, with the casing separated into two parts by a bypass packer, and with a plurality of spaced-apart spindle valves all fixed to and positioned along the tubing and above the check valve, with a bottom-most spindle valve positioned nearest the check valve and an upper-most spindle valve having the greatest opening pressure, and with a supply tube to the gas turbine that is fixedly-positioned along the tubing connected to the gas turbine near the upper end gas turbine inlet with a second check valve installed at the gas turbine outlet near the lower end;

said method of use comprising utilizing the device for recovery of liquids from liquid-bearing geological deposits having deposit pressure insufficient for natural flow.

* * * * *